US005912679A

United States Patent [19]

Takayama et al.

[11] Patent Number: 5,912,679

[45] Date of Patent: Jun. 15, 1999

[54] INK-JET PRINTER USING RF TONE BURST DRIVE SIGNAL

[75] Inventors: Satoshi Takayama, Kawasaki; Noriko Kudo, Yokohama; Shiroh Saitoh, Kawasaki; Mamoru Izumi, Tokyo; Chiaki Tanuma, Yokohama, all of Japan

[73] Assignee: Kabushiki Kaisha Toshiba, Kawasaki, Japan

[21] Appl. No.: 08/603,599

[22] Filed: Feb. 21, 1996

[30] Foreign Application Priority Data

Feb. 21, 1995 [JP] Japan ..... 7-032363

[51] Int. Cl.[6] ..... B41J 29/38; B41J 2/135; B41J 2/205; B41J 2/045

[52] U.S. Cl. ..... 347/10; 347/15; 347/46; 347/72

[58] Field of Search ..... 347/46, 15, 10, 347/11, 72; 310/366, 334

[56] References Cited

U.S. PATENT DOCUMENTS

| | | | |
|---|---|---|---|
| 4,308,547 | 12/1981 | Lovelady et al. | 346/140 |
| 4,348,079 | 9/1982 | Johnson | 350/358 |
| 5,202,659 | 4/1993 | DeBonte et al. | 346/1.1 |
| 5,233,256 | 8/1993 | Hayashi et al. | 310/317 |
| 5,241,236 | 8/1993 | Sasaki et al. | 310/358 |
| 5,266,964 | 11/1993 | Takahashi et al. | 346/1.1 |
| 5,285,215 | 2/1994 | Liker | 346/1.1 |
| 5,339,101 | 8/1994 | Rawson et al. | 347/46 |
| 5,369,420 | 11/1994 | Bartky | 347/19 |
| 5,381,171 | 1/1995 | Hosono et al. | 347/72 |
| 5,402,159 | 3/1995 | Takahashi et al. | 347/9 |
| 5,495,270 | 2/1996 | Burr et al. | 347/10 |
| 5,554,247 | 9/1996 | Pies et al. | 156/268 |
| 5,589,864 | 12/1996 | Hadimioglu | 347/46 |
| 5,591,490 | 1/1997 | Quate | 427/457 |
| 5,610,637 | 3/1997 | Sekiya et al. | 347/10 |
| 5,612,723 | 3/1997 | Shimura et al. | 347/46 |

FOREIGN PATENT DOCUMENTS

| | | |
|---|---|---|
| 0 272 092 | 6/1988 | European Pat. Off. . |
| 0 273 664 | 7/1988 | European Pat. Off. . |
| 0 493 052 | 7/1992 | European Pat. Off. . |
| 0 586 187 | 3/1994 | European Pat. Off. . |

OTHER PUBLICATIONS

Patent Abstracts of Japan, vol. 11, No. 330 (M–636), Oct. 28, 1987, JP–62–111757, May 22, 1987.

*Primary Examiner*—Safet Metjahic
*Assistant Examiner*—Christopher E. Mahoney
*Attorney, Agent, or Firm*—Oblon, Spivak, McClelland, Maier & Neustadt, P.C.

[57] ABSTRACT

A driving circuit controls a time for applying a drive signal to a piezoelectric element so as to bring a control in the number of ink droplets squirted from a liquid surface of liquid ink according to a gray scale level of an image to be printed on a printed object. According to application of the drive signal, acoustic waves emitted from a piezoelectric element array are focused in a main scanning direction, made incident to an acoustic lens via an acoustic matching layer, further focused in a direction orthogonal to the main scanning direction and focused in a vicinity of the liquid surface in a point form. In the vicinity of the liquid surface, an ink liquid mound is formed by means of pressure (discharging pressure) generated by the focused acoustic waves and then from a tip of the ink liquid mound an ink droplet according to the application time is squirted. The squirted ink droplet is ejected and stuck to the printed object. By performing main and subscanning to the printed object, a two-dimensional image is printed thereon.

18 Claims, 7 Drawing Sheets

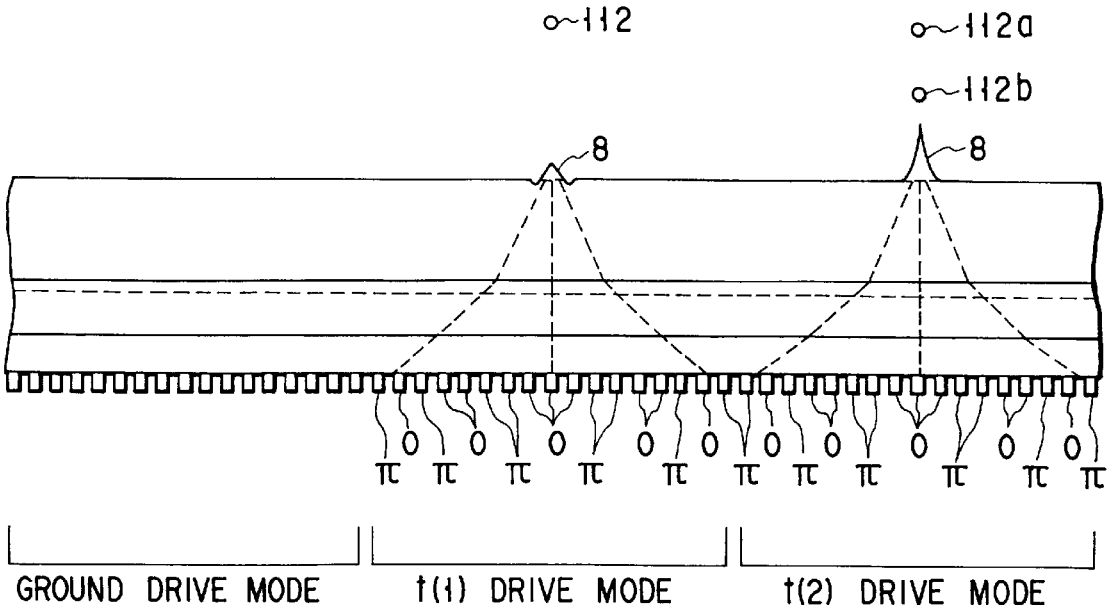
FIG. 4
FIG. 5A GROUND
FIG. 5B t(1) : PHASE 0
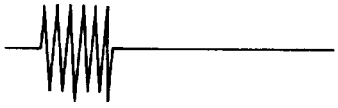
FIG. 5C t(1) : PHASE π
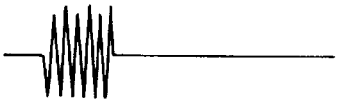
FIG. 5D t(2) : PHASE 0
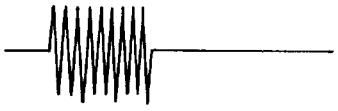
FIG. 5E t(2) : PHASE π
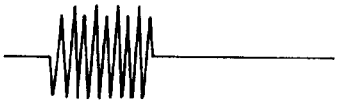

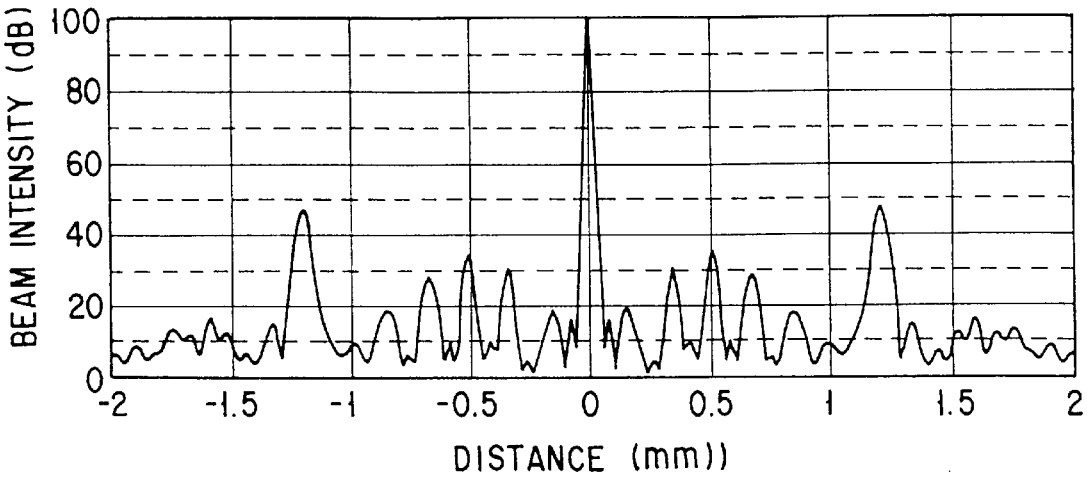
FIG. 9
FIG. 10A
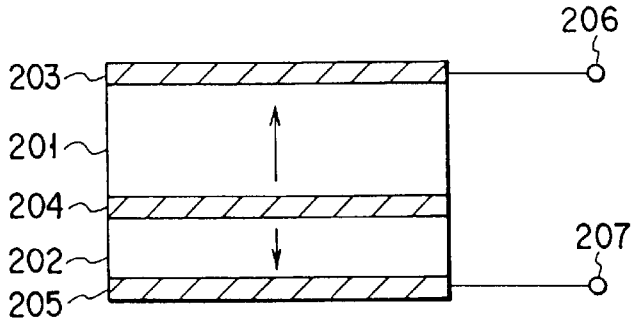
FIG. 10B
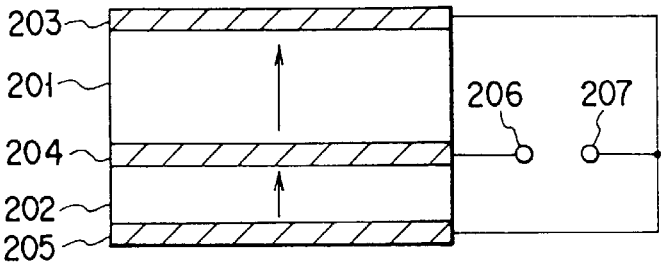
FIG. 10C
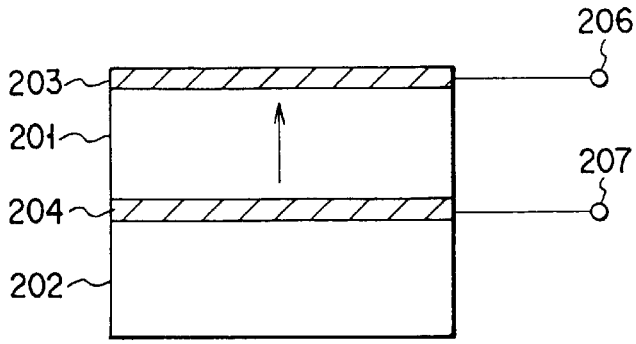

INK-JET PRINTER USING RF TONE BURST DRIVE SIGNAL

BACKGROUND OF THE INVENTION

1. Field of the Invention

The present invention relates to an ink-eject printer for printing images by changing liquid ink into droplets and ejecting these on objects to be printed, and in particular to an ink-eject printer for squirting ink droplets by pressure of acoustic waves emitted from piezoelectric elements and ejecting these ink droplets on the objects.

2. Description of the Related Art

A device for printing images by controlling liquid ink into small particles called droplets and ejecting these on a printing medium so as to form pixels has been practically used as an ink-eject printer.

Generally, in a device using an ink-eject printing system, local ink concentration easily occurs due to solvent evaporation or volatilization, causing clogging of an individual thin nozzle corresponding to resolution. For instance, in a system using vapor pressure for forming ink ejects, deposition of insolubles produced by thermal and chemical reaction with ink occurs, and in a system using pressure of a piezoelectric element, clogging of the nozzle occurs because of a complex ink flow passage, etc. Usually, in a serial scanning type head using several tens to hundred and several tens of nozzles, some treatments are given in order to reduce a frequency of clogging. However, in the case of a line scanning type head for which several thousands of nozzles are necessary, a frequency of clogging is high and thus reliability of an ink-eject printer declines.

In a conventional ink-eject printer, there are some problems to be solved when resolution is to be improved. For instance, in a device using vapor pressure, it is difficult to produce ink droplets having a particle diameter of 20 $\mu$m or less (equivalent to a printing dot having a diameter of about 50-odd $\mu$m). Also, in a device using pressure produced by a piezoelectric element, because of a complex structure of a printing head a problem occurs in terms of a technique for processing this printing head and thus it is difficult to manufacture one for realizing high resolution.

In recent years, there has been presented a system for ejecting ink from ink liquid surface by using pressure of acoustic waves generated by means of a piezoelectric element composed of a thin film piezoelectric element. This system is called a nozzleless system, in which a nozzle for each individual dot or any partitions for ink flow passages are not necessary. When this system is applied to the line scanning type head, clogging is prevented and restoration is rather easy even if clogging occurs. Moreover, this is suited for obtaining high resolution, since ink droplets of very small diameters can be stably produced and ejected.

In order to realize printing of high image quality in such an ink-eject printer using acoustic waves, it is necessary to increase gray scales in addition to improvement of resolution. An increase in gray scales means that it is possible to form desired gray-level of half tone pixels.

As described above, the improvement of resolution can be realized by forming ink droplets in fine particles. For the increase in gray scales, there has been presented a method for realizing a plurality of gray scales by, for instance controlling sizes of ink droplets or the number thereof in multi-levels. As an example, in Japanese Patent Application Kokai Publication No. 63-16645 by Xerox Co. Ltd., there have been disclosed two methods: the first is a method for squirting and ejecting a plurality of ink droplets by repeatedly driving a piezoelectric element of an ink-eject head for one pixel by a plural number of times and superpose the ink droplets on an object to be printed before the previously ejecting ink droplets are dried and the second is a method for controlling sizes of ink droplets by adjusting a drive signal applied to a piezoelectric element.

In the first method for performing printing per pixel by superpose a plurality of ink droplets, however, it is necessary to repeatedly drive the piezoelectric element by a plural number of times. As a result, when multi-level pixels are to be realized, it takes a long time to perform printing per a pixel and thus it is not suited to high-speed printing. In the second method for changing the sizes of ink droplets, an influence given on the sizes of ink droplets is relatively small and thus it is impossible to increase the number of gray scales.

SUMMARY OF THE INVENTION

It is an object of the invention to provide an ink-eject printer capable of performing high-speed printing of high image quality in multiple gray scale.

According to a first aspect of the invention, there is provided an ink-jet printer for printing images on a printing medium, comprising: an ink holding chamber for holding liquid ink; an acoustic wave generator having a piezoelectric element acoustically connected to the liquid ink, for generating acoustic wave; a signal source for applying a rf (radio frequency) tone burst to the piezoelectric element in order to emit acoustic wave; a first controller for changing a time to apply the rf tone burst in accordance with a desired gray-level of half tone so as to change a number of the ejected ink droplet of ink droplet group comprising at least one ink droplet.

According to a second aspect of the invention, there is provided an ink-jet printer for printing images on a printing medium, comprising: an ink holding chamber for holding liquid ink; an acoustic wave generator having a piezoelectric element acoustically connected to the liquid ink, for generating acoustic wave; a signal source for applying a rf (radio frequency) tone burst to the piezoelectric element in order to emit acoustic wave; a first controller for changing a time in order to eject n number of ink droplets the time is less than $n \cdot (t+T)$, where $(t+T)$ is a shortest time required to eject one ink droplet from the prescribed position, thereby to print images according to desired gray-level of half-tone level on the printing medium.

Furthermore, it is preferable that time intervals (blanking) for applying drive signals to the piezoelectric element is controlled to be long when a time for applying the drive signal is made long, that is, when the number of times for squirting ink droplets is increased, following control of the time for applying the drive signal according to a gray scale of the image to be printed on the printed object.

In the ink-eject printer having such a structure, it is possible to perform gray scale printing by controlling the time for applying the drive signal to the piezoelectric element so as to control the number of times for squirting ink droplets and by driving the piezoelectric element once. Therefore, high-speed gray scale printing can be performed and also the number of gray scales can be easily increased by making a controlling range of the drive signal applying time longer.

According to a third aspect of the invention, there is provided an ink-eject printer comprising: ink holding chamber for holding liquid ink; a piezoelectric element including a first electrode, a first piezoelectric layer, a second electrode and a second piezoelectric layer which are laminated in sequence for discharging acoustic waves focused in a vicinity of the liquid surface of the liquid ink held by the ink holding means; and driving means for printing an image by applying a rf (radio frequency) tone burst to the piezoelectric element so as to emit the acoustic waves therefrom and squirting an ink droplet from the liquid surface of the liquid ink by means of pressure of the acoustic waves and ejecting this on an object to be printed.

Here, to put it more specifically, the piezoelectric element is provided with a laminated structure constructed in such a manner that the first and second piezoelectric layers having different thickness are acoustically connected to each other in series, that is, the first electrode, the first piezoelectric layer, the second electrode and the second piezoelectric layer are laminated together in sequence, and when necessary a third electrode may even be formed on the second piezoelectric layer. In this case, the first and second piezoelectric layers are polarized facing in directions opposite to each other, or facing in the same directions, or only one is polarized. When the first and second piezoelectric layers are polarized facing in the opposite directions or in the same directions, the drive signal is applied based on a relationship that an electric field is applied in a direction reverse to a direction of polarization. When at least either one of the first or second piezoelectric layer is only polarized, the drive signal may be applied to the polarized piezoelectric layer.

In the ink-eject printer having such a structure, since the frequency of the acoustic waves emitted from the piezoelectric element can be controlled in more multilevels so as to increase the range of sizes of ink droplets, printing in multiple gray scale can be performed and also high-speed printing can be performed because one pixel can be printed by driving the piezoelectric element once. Moreover, since a size of an pixel and a density can be controlled by controlling sizes of ink droplets, in an area gradation method multi-level area gradation capable of obtaining the same gray scales within a smaller pixel compared with binary area gradation can be performed and this is also advantageous in terms of resolution.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying connectings, which are incorporated in and constitute a part of the specification, illustrate presently preferred embodiments of the invention and, together with the general description given above and the detailed description of the preferred embodiments given below, serve to explain the principles of the invention.

FIG. 4 is a model view illustrating drive processing of the ink-eject printer shown in FIGS. 3A to 3C;

FIGS. 5A to 5E are views showing wave forms of various signals applied to a piezoelectric element array in the drive processing of the ink-eject printer shown in FIGS. 3A to 3C;

FIG. 9 is a graph showing an example of an acoustic pressure distribution on an ink liquid surface in the ink-eject head part shown in FIGS. 8A to 8C;

FIGS. 10A to 10C are sectional views of various piezoelectric elements employed for an ink-eject head part in an ink-eject printer of a second embodiment of the invention;

DETAILED DESCRIPTION OF THE PREFERRED EMBODIMENTS

Now, explanation will be made of an ink-eject printer of first and second embodiments of the invention by referring to the accompanying connectings.

The ink-eject printer of the first embodiment will be described by referring to FIGS. 1A to 9.

First, a basic concept of the first embodiment will be explained by referring to FIGS. 1A to 2B. In a driving experiment of the ink-eject printer for performing image printing by squirting ink droplets using pressure of acoustic waves emitted from the piezoelectric element and ejecting these on an object to be printed, it was determined and confirmed by the inventors that when a condition exits in which the number of continuously ejected ink droplets (the number of ejects) (n) is two or more depending on an application time of rf (radio frequency) tone burst continuously applied when the piezoelectric element is driven once, a necessary shortest drive signal application time t(n) is longer than a drive signal application time t(1) necessary when the number of squirting ink droplets is one and clearly shorter than a time n times of this. It was also confirmed, under the same condition, that a state that a next drive signal can be applied to the piezoelectric element, more specifically a shortest blanking T(n) until a state is reached, in which no ejecting or satellite is generated from an ink liquid mound even by applying the drive signal, is longer than a blanking T(1) after an ink droplet is squirted and clearly shorter than a time n times of this. The term "blanking" means a period which lapses from the moment the application of the first rf tone burst is completed to the moment the application of the second rf tone burst is started.

It is necessary to apply the second rf signal after the ink droplet group has ejected which is caused by the first signal. If not, a splash occurs on the surface of the liquid ink, and the ink droplet is not ejected thereby. Note that the ink droplet group indicates at least one ink droplet.

As a result, it is clear that a shortest cycle under the condition of the n number of ejected ink droplets is t(n)+T(n), shorter than n[t(1)+T(1)] and this tendency is more conspicuous as n is larger. The first embodiment was made based on this concept, and a principle thereof will be explained hereinbelow.

Figure 1A:
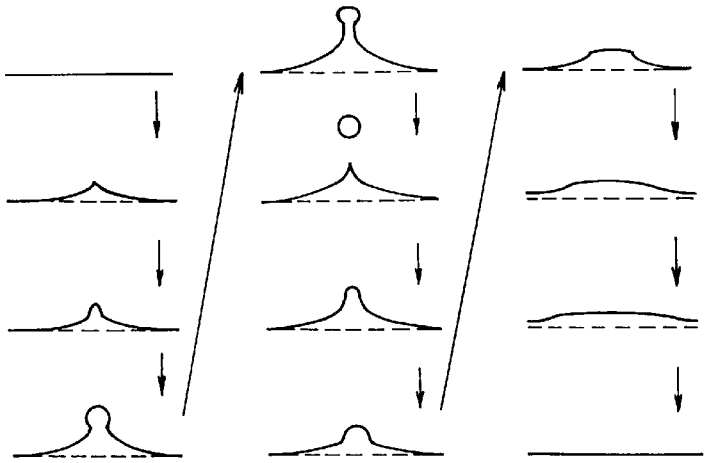
FIGS. 1A and 1B are views illustrating an ink ejecting principle in an ink-eject printer of a first embodiment of the invention and showing step of a squirting ink droplet group when the number of ejects is one and two.

FIG. 1A is a view showing a model ejecting process when the number of ink droplets to be squirted from an ink liquid surface is one. When acoustic waves focused in the ink liquid surface are emitted from the piezoelectric element, first by means of pressure thereof the ink liquid surface in a focusing region is pushed out and an ink liquid mound is formed. Then, when a tip of the ink liquid mound is constricted and one ink droplet is squirted. After this ink droplet is squirted, the ink liquid mound is pushed back because of surface tension and deformed and dropped increasing a bottom area thereof. When the ink liquid mound droplets up to a certain level, a state is reached in which next acoustic waves can be emitted. A blanking after squirting of the ink droplet until discharging of the next acoustic waves (a time interval for applying a drive signal) does not mean a time until the ink liquid mound completely disappears.

Figure 1B:
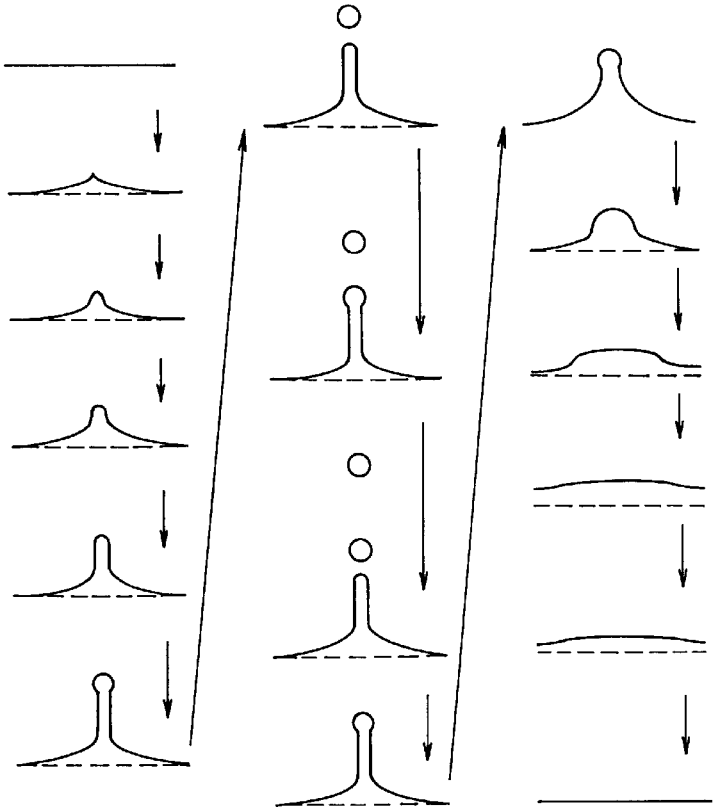

FIG. 1B is a view showing a model ejecting process when the number of ink droplets squirted from the ink liquid surface is two. In this case, the acoustic waves are emitted by applying the drive signal to the piezoelectric element longer than when the number of squirted ink droplets is one like that shown in FIG. 1A. When the acoustic waves focused in the ink liquid surface are emitted from the piezoelectric element by means of the drive signal applied longer, first the ink liquid surface as the focusing region is pushed out higher than that shown in FIG. 1A because of pressure of the acoustic waves, forming an ink liquid mound, and a first ink droplet (a first droplet) is squirted from a tip thereof. Then, a vicinity of the tip of the ink liquid mound with ink droplets lost for a relatively short period is constricted again and a second ink droplet (a second droplet) is squirted. Thereafter, as in the case that one ink droplet is squirted, the ink liquid mound is pushed back because of surface tension and deformed and dropped increasing a bottom area thereof. When the ink liquid mound drops up to a certain level, a state is reached in which the next acoustic waves can be emitted. However, the ink liquid mound shown in FIG. 1B is larger than that shown in FIG. 1A and thus a blanking must be longer than when one ink droplet is squirted.

To squirt an ink droplet forward, it is of course necessary to form an ink liquid mound on the surface of the ink. In the present invention, after an ink droplet has squirted but before the meniscus ceases to exist, the next ink droplet is squirted forward from the meniscus. Hence, the time required to grow the meniscus to its full size is shorter than in the case a rf tone burst is applied after the meniscus ceases to exist. As a result, the image gray scale can be controlled within a short time.

Figure 2A:
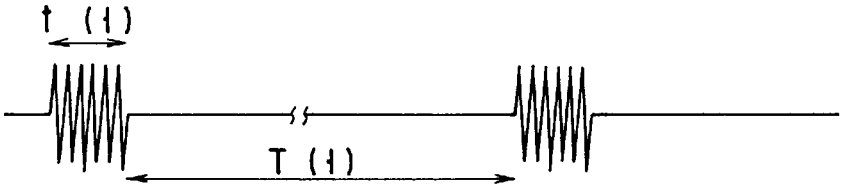
FIGS. 2A and 2B are views showing examples of wave forms of drive signals applied to a piezoelectric element so as to obtain the steps of squirting an ink droplet group shown in FIGS. 1A and 1B.
Figure 2B:
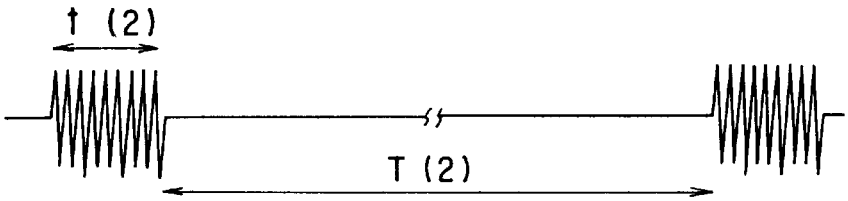

FIGS. 2A and 2B show examples of wave forms of drive signals applied to the piezoelectric element so as to obtain an ink droplet squirting process like that shown in FIGS. 1A and 1B. In FIG. 2A, a drive signal of a high frequency including a rf tone burst of a time width t(1) is applied to the piezoelectric element after a blanking T(1). In FIG. 2B, a drive signal of a high frequency including a rf tone burst of a time width t(2) is applied to the piezoelectric element after a blanking T(2). Here, the frequencies of the drive signals are set to 20 Mhz and periods of applying the drive signals and standby periods are respectively set to t(1)=10 μsec, T(1)=600 μsec, t(2)=15 μsec and T(2)=800 μsec.

By properly controlling the periods of applying the drive signals to the piezoelectric element, it is possible to make controls in the number of ink droplets to be squirted. Therefore, by controlling the application time of the drive signals to the piezoelectric element so as to control the number of squirted ink droplets in accordance with a gray scale level of an image to be printed on the printed object, it is possible to perform printing according to a predetermined gray scale.

As described above, a high-frequency rf tone burst is used for ejecting an ink droplet. The time tn of applying the rf tone burst for ejecting an ink droplet from the meniscus from which a previous ink droplet is given as follows:

where n is the number of ink droplets formed by continuous application of the bust signal and t1 is the time of applying the signal to eject one ink drop.

It is desirable that the time tn be equal to or greater than 1.2 t. In order to increase the printing speed, it is required that the time tn be equal to or less than 30 t. This is because the image gray scale can be controlled well when tn is equal to or less than about 30 t.

The series of acoustic waves used in the present invention may be discontinuous, provided that they impose no adverse influence on the ejecting of ink droplets. More specifically, the rf tone bursts may include discrete acoustic waves, so long as the discrete acoustic waves account for 3% or less of all rf tone bursts.

Next, the first embodiment will be described in detail.

Figure 3A:
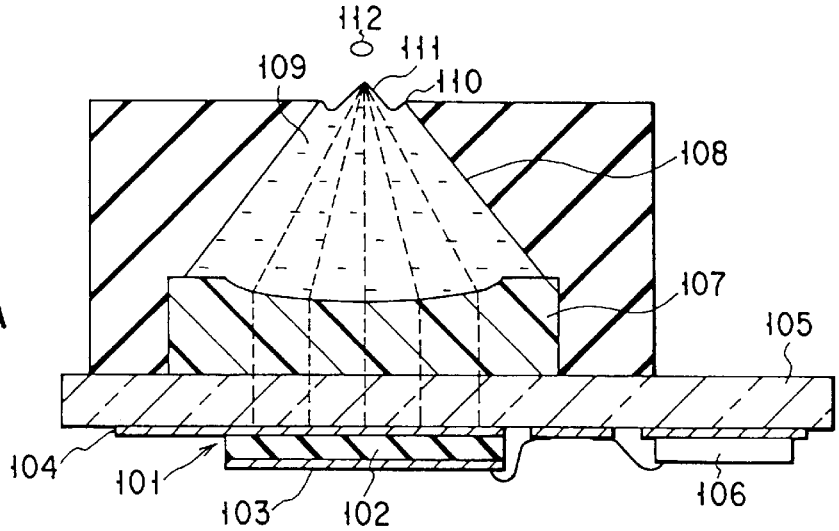
FIGS. 3A to 3C are views illustrating a structure of an ink-eject head part in the ink-eject printer of the first embodiment.
Figure 3B:
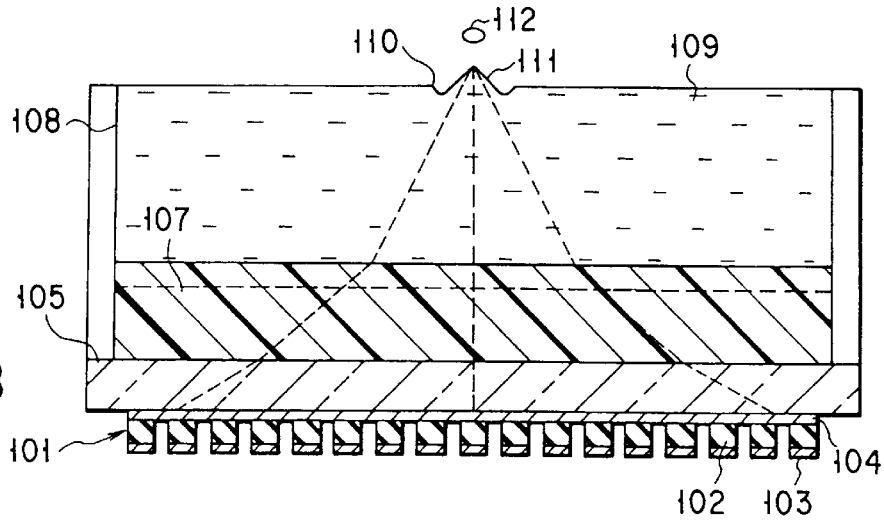
Figure 3C:
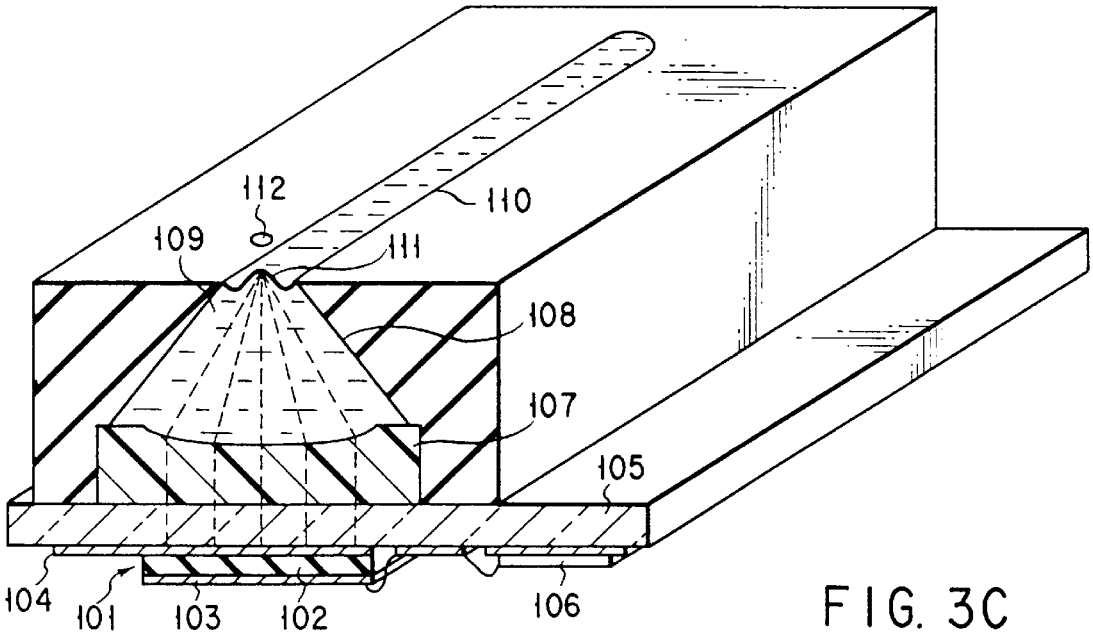

FIGS. 3A to 3C show an ink-eject head part in the ink-eject printer of the first embodiment of the invention. This ink-eject head part is an array type ultrasonic ink-eject head using a piezoelectric array in which a plurality of piezoelectric elements are one-dimensionally arrayed, FIG. 3A is a sectional view along a direction orthogonal to an main scanning direction, FIG. 3B is a sectional view along the main scanning direction and FIG. 3C is a perspective view of this ink-eject head part. The ink-eject head part shown in FIG. 3C is different in structure from those shown in FIGS. 3A and 3B and a drive IC (integrated circuit) is provided on a base substrate 8. There is no difference, however, in a basic structure of the ink-eject printer using the acoustic waves generated from the piezoelectric element.

A piezoelectric element array 101 is composed of a piezoelectric layer 102 having a thickness of several μm to several tens of μm and first and second electrodes 103 and 104 attached to both surfaces thereof. This piezoelectric element array 101 is formed on, for instance an acoustic matching layer 105 composed of a glass plate. The piezoelectric layer 102 is formed electrode in the main scanning direction as a whole, but elements thereof are separated so as to form a plurality of separated piezoelectric elements. The first electrode 103 is separated according to each piezoelectric element as in the case element separation of the piezoelectric layer 102 and the second electrode 104 is a beltlike electrode common in the piezoelectric elements. Each first electrode 103 is electrically connected to a drive IC 106 provided in the piezoelectric element array 101 side on the acoustic matching layer 105 by means of wire bonding, etc., the second electrode 104 as a common electrode is electrically grounded.

On a surface in a side opposite to the piezoelectric element array 101 of the acoustic matching layer 105, there is adhered a cylindrical planoconcave lens 107 for focusing acoustic waves in the main scanning direction of the piezoelectric element array 101 and a direction for discharging the acoustic waves and a surface in a side opposite to the acoustic matching layer 105 of this acoustic lens 107 is in contact with a bottom surface of ink 109 in an ink chamber 108. In the embodiment, a cylindrical planoconcave lens is used for the cylindrical planoconcave lens 107, but a fresnel acoustic lens having no curvature on a surface can be employed as described later.

The ink chamber 108 has a form gradually narrowing so as to envelope a passage of the acoustic waves focused by means of phased array scanning of the piezoelectric array 101 and diffraction of the cylindrical planoconcave lens 107. Also, in a vicinity of a focusing point of the acoustic waves, a slit formed plate 110 having a width of about several tens of $\mu$m to several hundreds of $\mu$m is provided. A surface of the ink 109 (ink liquid surface) is positioned almost on the same plane as the slit 110.

The drive IC 106 performs electronic scanning by driving a specified number of adjacent piezoelectric elements in the main scanning direction of the piezoelectric element array 101 as one block by block units according to gray scale image data. More specifically, by supplying rf tone burst drive signals having a specified phase difference to the respective piezoelectric elements of a selected block and simultaneously driving the piezoelectric elements, the acoustic waves emitted from the piezoelectric element array 101 are focused in the main scanning direction. This focus processing in the main scanning direction is repeated by shifting positions of the simultaneously driven piezoelectric elements by, for instance one element in sequence and thereby a direction of discharging the acoustic waves to be focused can be linearly moved in the main scanning direction.

The acoustic waves emitted from the piezoelectric element array 101 and focused in the main scanning direction in accordance with such processing by the drive IC 106 are made incident to the cylindrical planoconcave lens 107 via the acoustic matching layer 105, further focused in a direction orthogonal to the main scanning direction and in the end focused in the vicinity of the ink liquid surface in a point form. In the vicinity of the ink liquid surface, by means of pressure generated by the focused acoustic waves (discharging pressure) a conical ink liquid mound 111 is formed thereon and then an ink droplet 112 is squirted from a tip thereof. The squirted ink droplet 112 is ejected and stuck to an object to be printed, not shown, the ink droplet 112 ejected and stuck thereto is dried and deposited. In this case, since main scanning is performed by means of a movement of the acoustic waves in the main scanning direction of the piezoelectric element array 101, subscanning is performed by moving the printed object in a direction orthogonal to the main scanning direction (main scanning direction) of the ink-eject head part. It is possible to print a two-dimensional image on the object to be printed by properly performing such main or subscanning.

The drive IC 106 is provided with a function for controlling the time of applying the drive signal to the piezoelectric element array 101 so as to contrail the number of ink droplets squirted from the ink liquid surface in accordance with a gray scale level of an image to be printed on the printed object, that is, in accordance with a density of image data. Controlling of the time of applying the drive signal by the drive IC 106 will be described hereinbelow by referring to FIGS. 4 to 5E.

FIGS. 4 to 5E are views illustrating an example of drive processing of the piezoelectric element array 101 of the first embodiment, in which the number of ink droplets squirted from the ink liquid surface of the ink-eject head is 0 to 2. As shown in FIG. 4, as a drive mode for each block of the piezoelectric element array 101, there are preset three kinds of modes: a ground drive, t(1) drive and t(2) drive.

The ground drive mode is one for controlling a voltage for applying the drive signal to the piezoelectric element in the block like a drive signal wave form shown in FIG. 5A (no drive signal is applied). Thus, no acoustic waves are emitted from the block to which this ground mode signal has been supplied, preventing the ink droplets from being squirted. The t(1) mode is one using a combination of 0 phase and $\pi$ phase drive signals of time widths t(1) previously explained by referring to FIG. 2A as drive signals to be applied to the piezoelectric element within the block like a drive signal wave form shown in FIGS. 5B and 5C. In this mode, the focused acoustic waves are emitted from the block to which the signal has been supplied and one ink droplet 112 is squirted from the ink liquid surface as shown in FIG. 1A. The t(2) mode is one using a combination of 0 phase and $\pi$ phase signals of time widths t(2) previously explained by referring to FIG. 2B as drive signals to be applied to the piezoelectric element within the block like a drive signal wave form shown in FIGS. 5D and 5E. In this mode, the focused acoustic waves are emitted from the block to which the signal has been supplied and two ink droplets 112*a* and 112*b* are squirted from the ink liquid surface as shown in FIG. 2B.

Furthermore, in the t(1) and t(2) drive modes, standby periods, that is, intervals for applying the drive signals, are differently set like T(1) and T2(2) as shown in FIGS. 2A and 2B.

Next, explanation will be made of an example of a circuit structure for realizing the driving method explained by referring to FIGS. 4 to 5E.

Figure 6:
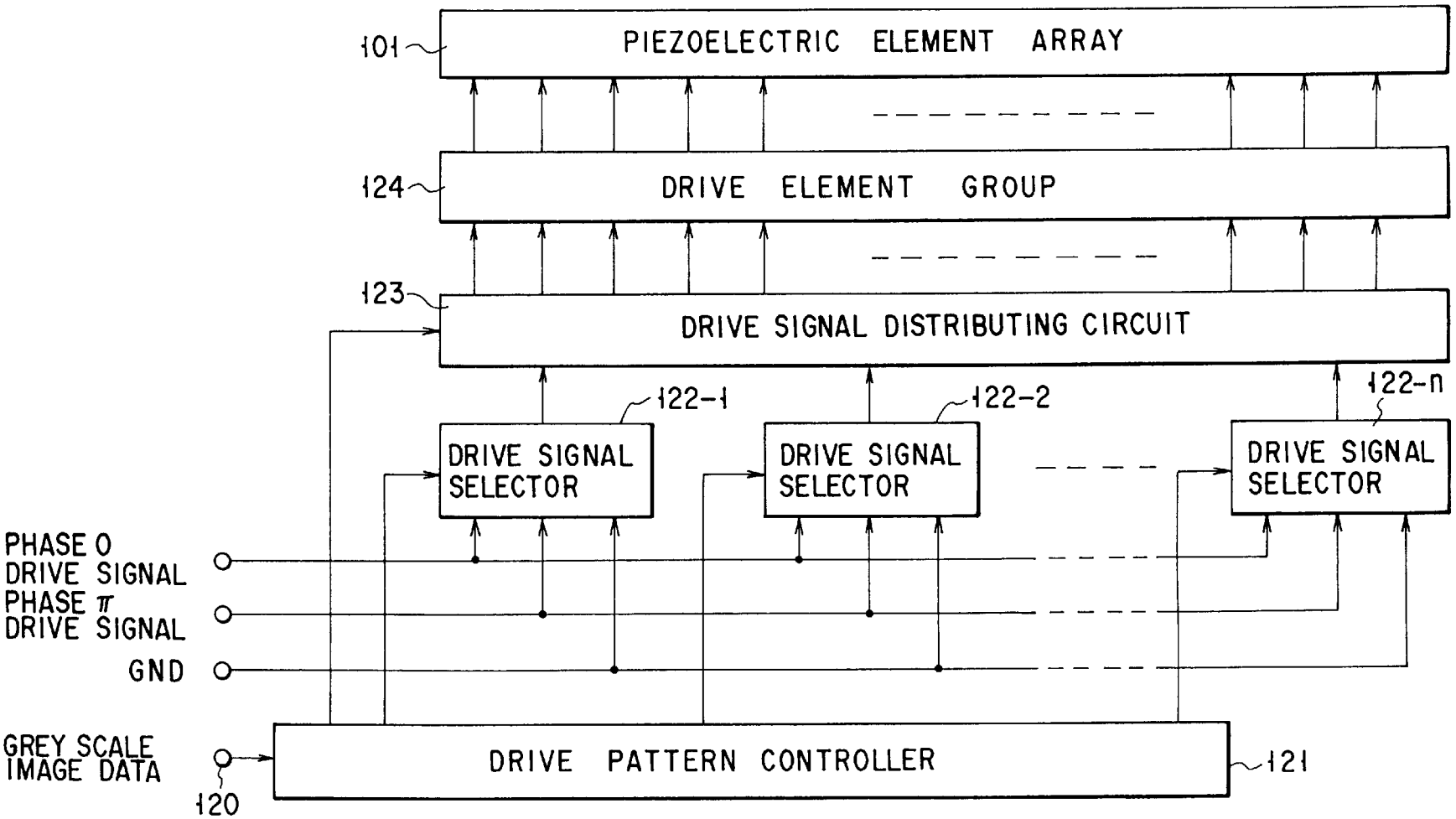
FIG. 6 is a block diagram showing an example of an internal structure of a drive IC in the ink-eject printer shown in FIGS. 3A to 3C.

FIG. 6 is a block diagram showing an internal structure of the drive IC 106 shown in FIGS. 3A to 3C. In the connecting, serially input gray scale image data 120 is input to a drive pattern control circuit 121. The drive pattern control circuit 121 is a circuit for controlling n pieces of drive signal selectors 122-1 to 122-n and a drive signal distributing circuit 123. Here, n is equal to the number of piezoelectric elements within one block of the piezoelectric element array 101, that is, the number of simultaneously driven piezoelectric elements (hereinafter called simultaneously driven element number).

The drive signal selectors 122-1 to 122-n are circuits for selecting either one of a 0 phase drive signal, a $\pi$ phase drive signal or a ground level signal (GND) as a nondrive signal, selection of any one of the 0 phase signal, the $\pi$ phase signal and the nondrive signal is controlled by means of the drive pattern control circuit 121 and a time for outputting the selected signal (drive signal application time) and an outputting interval thereof (drive signal application time interval) are also controlled by means of the drive pattern control circuit 121.

The drive signals selected by the drive signal selectors 122-1 to 122-n are input to the drive signal distributing circuit 123. The drive signal distributing circuit 123 supplies n pieces of the drive signals selected by the drive signal selectors 122-1 to 122-n to a drive element group 124. The drive element group 124 is composed of drive elements corresponding one to one to the piezoelectric elements of the piezoelectric element array 101 shown in FIGS. 3A to 3C and applies the high frequency drive signals between the first and second electrodes 103 and 104 of the piezoelectric element array 101.

When the gray scale image data 120 equivalent to one pixel is input, selector signals are supplied from the drive pattern control circuit 121 to the drive signal selectors 122-1 to 122-n and based on these the drive signal selectors 122-1 to 122-n select either one of the 0 phase drive signal, the π phase drive signal or the nondrive signal. More specifically, when a density value of the gray scale image data is, for instance "0", the drive signal selectors 122-1 to 122-n select the nondrive signal. When a density value of the gray scale data 120 is "1", the drive signal selectors 122-1 to 122-n select the 0 phase drive signal or the π phase drive signal and output this for a time t(1), and when a density value of the gray scale image data 120 is "2", the drive signal selectors 122-1 to 122-n select the 0 phase drive signal or the π phase drive signal and output this for a time t(2).

The drive signals thus selected by the drive signal selectors 122-1 to 122-n are input, by means of a drive signal distributing circuit 13 controlled by the drive pattern control circuit 121, to n pieces of drive element groups 124 selected according to which pixel in one line in a main scanning direction currently input gray scale image data 40 belongs to. The drive signals are voltage-amplified by means the n pieces of drive element groups 124 and are simultaneously applied to n pieces of corresponding piezoelectric elements of the piezoelectric element array 101.

That is, when the gray scale image data 120 is data of a first pixel, the drive signals are input to the drive elements corresponding to the piezoelectric elements of first to nth of the piezoelectric element array 101, when this is data of a second pixel, the drive signals are input to the drive elements corresponding to the piezoelectric elements of second to (n+1)th of the piezoelectric element array 101 and thereafter similarly corresponding to data of ith, the drive signals are input to the drive elements corresponding to the piezoelectric elements of ith to (n+i) of the piezoelectric element array 101. Therefore, when data equivalent to one line is input as the gray scale image data, the acoustic waves emitted from the piezoelectric element array 101 are linearly moved by one line, making it possible to perform printing of one line. In this case, the number of gray scales of the printed image is three of gray scale levels "0" to "2".

When the gray scale level is "1" or "2", the drive signal selectors 122-1 to 122-n select either the 0 phase drive signal or the π phase drive signal. However, selection of either of the signals is predetermined by, for instance an expression of Fresnel diffraction and this it is assumed that this is programmed in the drive pattern control circuit 121. Therefore, the acoustic waves emitted from each block composed of n pieces of the piezoelectric elements of the piezoelectric element array 101 are focused in the main scanning direction of the piezoelectric element array 101.

As described above, according to the first embodiment, since the number of squirting ink droplets is controlled by controlling the time for applying the drive signals to the piezoelectric element and gray scale printing can be performed by one driving of the piezoelectric element, it is possible to perform high-speed gray scale printing and to easily increase the number of gray scales by controlling a controlling range of the drive signal application time. Therefore, it is possible to realize the ink-eject printer capable of performing multi-level, high-speed and high image quality printing.

Figure 7:
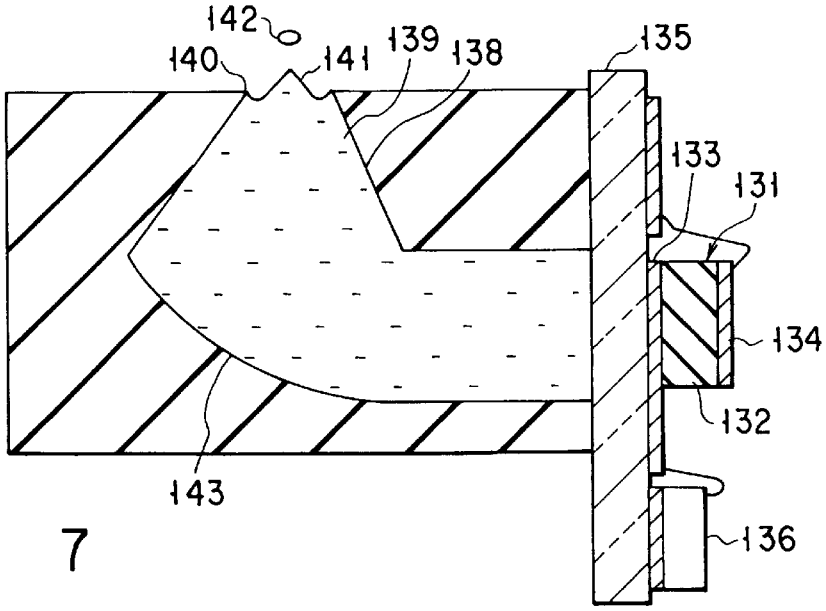
FIG. 7 is a view showing a modified example of the ink-eject head part in the ink-eject printer of the first embodiment.

Next, explanation will be made of a modified example of the ink-eject head part in the ink-eject printer of the first embodiment. FIG. 7 is a sectional view showing a structure of this modified example. While in the ink-eject head part shown in FIGS. 3A to 3C the piezoelectric element 101 and the acoustic matching layer 105 are horizontally arranged, in this modified example a piezoelectric element 131 and an acoustic matching layer 135 are vertically arranged. A structure of the piezoelectric element 131 is basically similar to that shown in FIG. 3A, being composed of first and second electrodes 133 and 134 attached to both surfaces of a piezoelectric layer 132. The first electrode 133 connected to a drive IC 136 is provided in contact with the acoustic matching layer 135 and the second electrode 134 is wire-bonded and grounded. Also, in this modified example, an ink chamber 138 is extended to a front of the acoustic matching layer 135 and a concave mirror 143 is formed on a bottom surface of the ink chamber 138. This concave mirror 143 is used instead of the acoustic lens 107 shown in FIG. 3A, acoustic waves emitted from the piezoelectric element 131 and made incident to the concave mirror 143 via the acoustic matching layer 135 are moved upward in the connecting after being reflected by the concave mirror 143 and focused. The ink chamber 138 has a form gradually narrowing so as to envelope passages of the acoustic waves reflected by the concave mirror 143 and focused and becomes a slit formed orifice 140 having a width of several tens gm to several hundreds μm. A surface of ink 139 (ink liquid surface) is positioned almost on the same plane as the orifice 140 as in the case of the first embodiment.

Drive control of the piezoelectric element 131 in this modified example is the same as the processing previously described and thus detailed explanation will be omitted. Also, by performing the above-described drive control, it is possible to obtain the same effects as in the embodiment explained by referring to FIGS. 3A to 6.

Next, explanation will be made of an example of using, instead of the cylindrical planoconcave lens 107, a fresnel acoustic lens in the first embodiment by referring to FIGS. 8A to 8C.

Figure 8A:
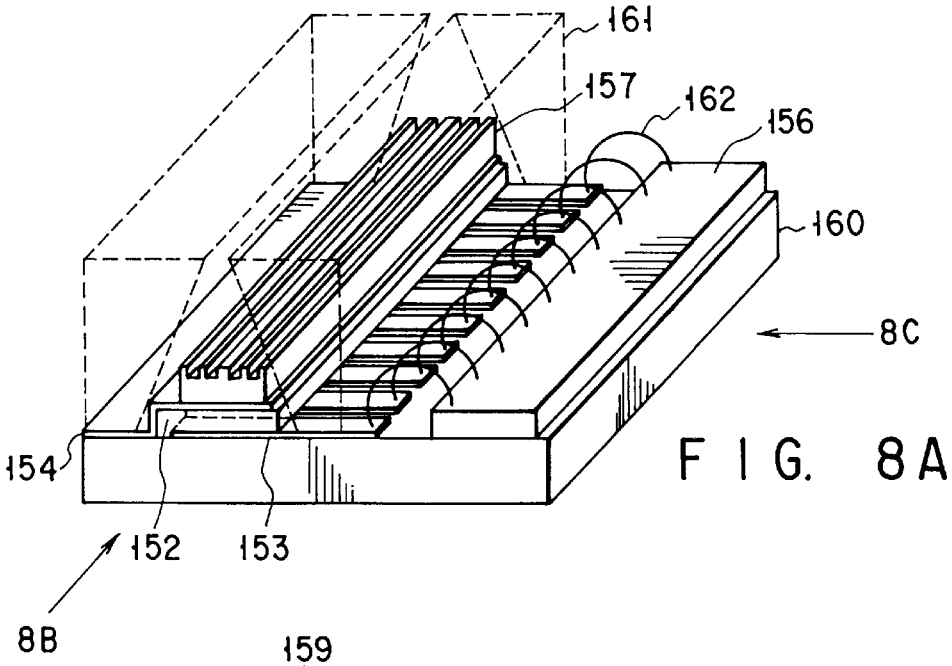
FIGS. 8A to 8C are views illustrating the ink-eject head part in the ink-eject printer of the first embodiment when a Fresnel acoustic lens is employed.
Figure 8B:
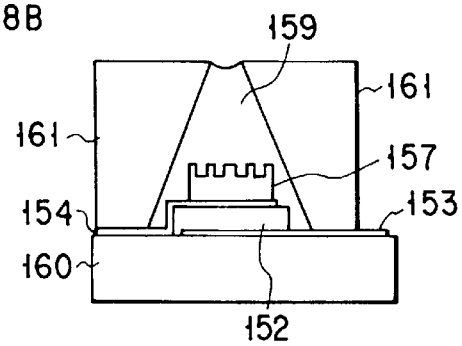
Figure 8C:
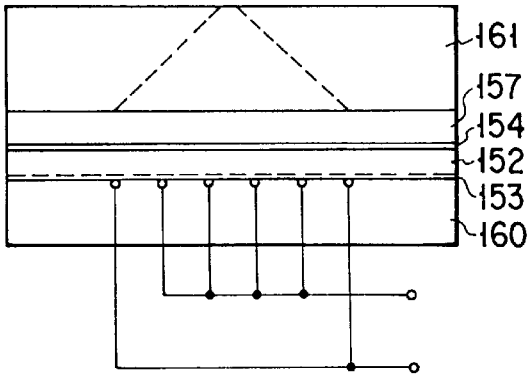

FIG. 8A is a perspective view showing an outline of the ink-eject head in the ink-eject printer using the fresnel acoustic lens in the first embodiment, FIG. 8B is a plan view showing an outline of the ink-eject head part shown in FIG. 8A when seen from a 8B direction and FIG. 8C is a plan view showing an outline of the ink-eject head shown in FIG. 8A when seen from a 8C direction. On a glass substrate 160 having a thickness of 1.1 mm and also serving as a gasket material, Ti/Au electrodes are formed by means of an EB vapor deposition method so as to be provided with thicknesses of 0.05 μm and 0.3 μm and then individual electrodes 153 disposed in an array form are formed by giving etching processing. In this individual electrode 153, a ZnO thin film having a dielectric constant of 10 and a film thickness of 28 μm is formed by using a rf sputter as a piezoelectric element 152. On the piezoelectric element 152, a common electrode 154 is formed so as to realize thicknesses of Ti/Au electrodes 0.05 μm and 0.3 μm. A length of an electrode in a subscanning direction, that is, a diameter, is 2.04 mm and a surface opposite to a surface on which the piezoelectric element 152 of the glass substrate 160 is formed has a surface roughness of 5 μm given sandblasting processing. An acoustic lens (fresnel acoustic lens) 157 serves also as an acoustic matching layer, a mixture of an epoxy resin and alumina powders are coated on the common electrode 154 and made solid so as to realize a density of 2.20×103 kg/m$^3$, a sonic acoustic speed of 2.95 m/s and a thickness of 22 μm and etching processing is given so as to form a specified pattern.

By applying voltages to both ends of the piezoelectric element 152, acoustic waves are generated from the piezoelectric element. On the common electrode 154, the acoustic lens 157 is disposed so as to focus acoustic waves generated from the respective piezoelectric elements on an ink liquid surface and to make focusing points generated therefrom linear in parallel with a main scanning direction.

Any material can be used for the piezoelectric element 152 as long as this is a piezoelectric material, and it is possible to use, for instance ceramic of a zircon titanium acid chloride, etc., high molecules of a copolymer of a vinylidene fluoride and an ethylene trifluoride, etc., single crystals of a niobic acid lithium, etc., and piezoelectric semiconductors of a zinc oxide, etc. As for electrodes to be formed on the piezoelectric element 152, it is usually possible to form Ti, Ni, Al, Cu and Au by means of a thin film forming method by vapor deposition or sputtering and a fire by screen printing in which frit silver paste.

Ultrasonic waves generated from the piezoelectric element are transmitted to ink held by a side wall 161 and focused in the vicinity of an ink liquid surface. Components of the ultrasonic waves generated therefrom in a main scanning direction are focused by controlling a piezoelectric element group comprising m pieces of piezoelectric elements. That is, the drive IC 156 applies a drive voltage to the individual electrode 153 via a wiring 162 with a timing that acoustic waves generated from the simultaneously driven piezoelectric elements of the piezoelectric element group are focused in one point in the vicinity of the ink liquid surface and thereby the acoustic waves are focused in the main scanning direction.

By means of such processing, it is possible to focus the ultrasonic waves generated from the piezoelectric element group so as to generate acoustic pressure sufficient for ejecting ink droplets in one point in the vicinity of the ink liquid surface. This makes it possible to eject one droplet of ink.

Furthermore, in adjacent printing positions on which printing cannot be simultaneously performed, by shifting the group of the simultaneously driven piezoelectric elements according to the targeted printing positions, the acoustic waves can be scanned in the main scanning direction.

Next, explanation will be made of the Fresnel drive. As described above, the ultrasonic wave components in the main scanning direction are focused on a specified liquid surface by providing each of the piezoelectric elements of the group, that is, simultaneously driving the piezoelectric elements by providing phase differences. As a method for setting such phase differences, there is available one for dividing n pieces of piezoelectric elements into two kinds based on a theory of Fresnel zone. More specifically, first a radius of a Fresnel zone is obtained by using the following expression (1) or (2):

$$r(n)=[(2n-1)\lambda i/2\times\{F+(2n-1)\lambda i/8\}]12 \quad (1)$$

$$r(n)=(n\lambda iF)12 \quad (2)$$

Here, λi is a wavelength of an ultrasonic wave in an ink liquid, F is a focal length and n is an integer of 0 or more indicating a depth of the ink liquid.

Here, if a distance from a center position of the piezoelectric element group is D, the following expression applies:

$$r(2n)<D<r(2n+1)$$

Each delay time is set so as to make a phase of the piezoelectric element within this range opposite to that of the piezoelectric element within the range of the following expression:

$$r(2n)<D<r(2n+2)$$

In a case where a drive frequency is 50 MHz, that is, a wavelength of an ultrasonic wave in the ink liquid is 30 μm and a focal length is 3.3 mm, a radius r(n) (n=0 to 10) of each Fresnel zone obtained by the above-described expression (1) is as shown in the following table 1:

TABLE 1

| n | r(n) [mm] |
|---|---|
| 0 | 0 |
| 1 | 0.2226 |
| 2 | 0.386 |
| 3 | 0.4989 |
| 4 | 0.591 |
| 5 | 0.6709 |
| 6 | 0.7425 |
| 7 | 0.8081 |
| 8 | 0.869 |
| 9 | 0.9262 |
| 10 | 0.9802 |

Here, the number m of simultaneously driven elements in a first drive mode is 24 and a pitch of arraying the piezoelectric elements is 85 μm (#1/300 inch). A phase arraying pattern of the piezoelectric element group determined by the Fresnel zone in this case is as shown in the following table 2:

TABLE 2

| PIEZOELECTRIC ELEMENT NO. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| PHASE | π | 0 | 0 | π | 0 | π | 0 | π | π | 0 | 0 | 0 | 0 | 0 | 0 | π |

| PIEZOELECTRIC ELEMENT NO. | 17 | 18 | 19 | 20 | 21 | 22 | 23 | 24 |
|---|---|---|---|---|---|---|---|---|
| PHASE | π | 0 | π | 0 | π | 0 | 0 | π |

Here, phases of the drive signals applied to the respective piezoelectric elements are represented by 0 and π opposite thereto. By driving the piezoelectric element group comprising twenty-four elements by means of the phase arraying pattern shown in the table 2, the acoustic waves emitted from each element are focused in the ink liquid surface on a middle point between the eighth and ninth piezoelectric elements. Thus, ink droplets are ejected from the middle point between the eighth and ninth piezoelectric elements. A sonic field (acoustic pressure distribution) on the ink liquid surface at this time is shown in FIG. 9.

In a case where on the same scanning line positions for simultaneously ejecting ink droplets are away from each other more than a width (85 μm×12=1.36 mm) of the group of the simultaneously driven elements, by constructing piezoelectric element groups in a plurality of positions on the array using the above-described drive mode and driving these, ink droplets can be ejected from the plurality of positions. Also, in a case where a priority is given to improvement of a quality of an printed image by making forms of ejecting ink droplets uniform rather than a printing speed, a scanning method may be employed, in which only the drive mode is used and combinations of the simultaneously driven piezoelectric element groups are shifted in sequence in the main scanning direction.

A groove of the acoustic lens 157 is processed by adjusting a focal length in a predetermined position based on the theory of Fresnel zone.

The drive control described above is limited to a case where a droplet of ink is ejected and in order to realize multilevles the same drive control as previously described may be performed. Detailed explanation will be omitted. By performing the drive control, the same effects as described by referring to FIGS. 3A to 6 can be obtained.

Furthermore, by using the fresnel acoustic lens instead of the cylindrical planoconcave lens, the lens is structured planar and laminated including the acoustic matching layer. therefore, production is made possible by using such lithography techniques as patterning, etching and the like, improving manufacture thereof.

Next, explanation will be made of an ink-eject printer in a second embodiment of the invention by referring to FIGS. 10A to 13. In the second embodiment, by using a piezoelectric element having a structure for exciting not only odd numbered but also even numbered ultrasonic waves, sizes of ink droplets emitted by controlling a frequency of a drive signal applied to this piezoelectric element is controlled and multi-level printing is performed.

FIGS. 10A to 10C are sectional views showing various examples of laminated type piezoelectric elements employed for the second embodiment. In the piezoelectric element shown in FIG. 10A, first and second piezoelectric layers 201 and 202 are acoustically connected to each other in series, and as shown by arrows in the connecting, the piezoelectric layers 201 and 202 are polarized in opposing directions. Electrodes 203, 204 and 205 are respectively provided on a surface of a side of the piezoelectric layer 201 opposite to the piezoelectric layer 202, between the piezoelectric layer 201 and the piezoelectric layer 202 and on a surface of a side of the piezoelectric layer 202 opposite to the piezoelectric layer 201. In the electrodes 203 and 205 on both sides of this laminated type piezoelectric element, a pair of connector terminals 206 and 207 are provided. By applying a high frequency drive signal between these connector terminals 206 and 207, electric fields are applied to the piezoelectric layers 201 and 202 in opposing directions.

The piezoelectric element shown in FIG. 10B is different from the piezoelectric element shown in FIG. 10A in that the piezoelectric layers 201 and 202 are polarized in the same direction as shown by the arrow in the connecting and the connector terminals 206 and 207 are provided respectively in the electrode 203 and the inner layer electrode 204. Here, when a high frequency drive signal is applied between the connector terminals 206 and 207, electric fields are applied to the piezoelectric layers 201 and 202 in directions opposite to each other.

The piezoelectric element shown in FIG. 10C is different from that shown in FIG. 10A in such a manner that only the first piezoelectric layer 201 is polarized and the connector terminals 206 and 207 are provided in the electrode 203 and the electrode 204 in the inner layer. In this case, by applying a high frequency drive signal between the connector terminals 206 and 207, an electric field is applied only to the piezoelectric layer 201.

As a piezoelectric material for constructing the piezoelectric layers 201 and 202, such ceramic piezoelectric materials as zirconic acid titanium acid chloride (PZT) and titanium acid chloride, such semiconductor piezoelectric materials as ZnO and AlN and such high molecule piezoelectric materials as polyfluoride vinylidene (PVDF) and a copolymer of polyfluoride vinylidene and biflouoride ethylene (P(VDF—TrFE)) may be used.

As materials for the electrodes 203, 204 and 205, a metal vapor deposited film of a single or laminated layer made of Ti, Ni, AI, Cu, Cr and Au, etc., or a metal fired film given fire after a mixture of silver paste and glass frit is print-coated thereon may be used. Furthermore, as for the inner layer electrode 204, the piezoelectric layers 201 and 202 on both sides may be stitched together after an electrode is formed in either of these or in both, or when the piezoelectric layers 201 and 202 are made of ceramic materials, it is possible to manufacture the electrode 204 by integrally calcining this with the piezoelectric layers 201 and 202 by using a doctor blading method. In particular, when the electrode 204 and the piezoelectric layers 201 and 202 are integrally calcined, it is predetermined that for the electrode 204 an electrode material having a higher melting point than a temperature for integral calcination must be used, and for instance one made by mixing ceramic powders with Pt, Ag/Pd may be used.

In the piezoelectric element shown in FIG. 10C, the nonpolarized piezoelectric layer 202 may be replaced by a nonpiezoelectric material having the same acoustic impedance as the polarized piezoelectric layer 201. Thus, it is possible to employ a mode, in which a polarized piezoelectric element having a single plate structure is fixed on a circuit board by means of a resin having the same acoustic impedance as the piezoelectric layer.

The electrode 204 shown in FIG. 10A is used for polarizing the piezoelectric layers 201 and 202 and a function as an electrode is not necessary after polarization. Therefore, a reliability of the piezoelectric element shown in FIG. 10A is improved more compared with the piezoelectric element shown in FIGS. 10B and 10C having a possibility that the electrode 204 formed as an internal electrode in the piezoelectric layers 201 and 202 may diffuse therein and the reliability as an electrode may decline. Also, a process for manufacturing the piezoelectric element shown in FIG. 10C can be made simple because it is not necessary to from an electrode 205 and a thickness of the piezoelectric layer 201 between the electrodes 203 and 204 can be optionally set (except the same thickness as the piezoelectric layer 202), making it easy to set wiring with the drive circuit, etc.

Next, explanation will be made of a relationship between the piezoelectric layer and a fundamental frequency in the piezoelectric element shown in FIGS. 10A to 10C.

In the piezoelectric element shown in FIGS. 10A to 10C, a fundamental frequency fl is determined by a total thickness of the piezoelectric layers 201 and 202 and more specifically this is a frequency in which t is almost a half wave form. No reflection on a surface between the piezoelectric layers 201 and 202 is a condition for generating an n higher harmonic of fl (n is an integer of 2 or more). In order to satisfy such a condition, it is predetermined that the piezoelectric layers 201 and 202 must be made of the same materials. However, use of the same materials is not always necessary as long as an acoustic impedance (product between a density and a sonic speed) is within ±20%.

When each thickness is controlled by fixing the total thickness t of the piezoelectric layers 201 and 202 shown in FIGS. 10A to 10C, conversion efficiency of odd-numbered higher harmonic and even-numbered higher harmonic including the fundamental frequency into ultrasonic waves with respect to drive voltages, that is, electromechanical coupling coefficient, is controlled. Usually, energy needed for ejecting ink droplets is smaller when the fundamental frequency is higher. The amplitudes of ultrasonic waves excited by a fundamental frequency and the amplitudes of ultrasonic waves excited by a secondary harmonic frequency can be adjusted by changing the thickness ratio between the piezoelectric layers 201 and 202. Consequently, the minimum drive voltage required for ejecting ink droplets can be almost the same between the case where odd-numbered harmonic frequencies including the fundamental frequency are used and the case where even-numbered harmonic frequencies including the fundamental frequency are used.

A difference in structure between the piezoelectric layers shown in FIGS. 10A to 10C is characterized by electrical matching with the drive circuit and simplicity for connecting a lead from the electrode in order to provide the connector terminal. A difference between FIGS. 10A and 10B is that the piezoelectric layers 201 and 202 are electrically connected to each other in series or in parallel and electrical impedance is larger for the piezoelectric element shown in FIG. 10A. In FIG. 10C, impedance is determined only by the piezoelectric layer 201. Thus, the respective piezoelectric elements shown in FIGS. 10A to 10C are differently used depending on a dielectric constant a frequency constant of a used piezoelectric material. As for connecting the lead from the electrode, in the piezoelectric element shown in FIG. 10A the connector terminals 206 and 207 are both from the external electrodes while in FIGS. 10B and 10C one connector terminal is from the internal electrode. Therefore, as in the case of the above-described matching, a structure of the piezoelectric element is selected depending on use.

It is predetermined that thicknesses of the electrodes 203, 204 and 205 must be 1% or less of a wave form determined by a drive frequency. This is because an influence on resonance of the piezoelectric material must be prevented since usually there is a difference in acoustic impedance between the electrode material and the piezoelectric material.

As described above, by switching frequencies of the drive signals applied to the piezoelectric element depending on a gray scale level of an image to be printed on the printed object, it is possible to control the sizes of ink droplets and to perform multilevel printing.

Next, explanation will be made of an example of an ink-eject printer using the above-described laminated layer type piezoelectric element.

Figure 11:
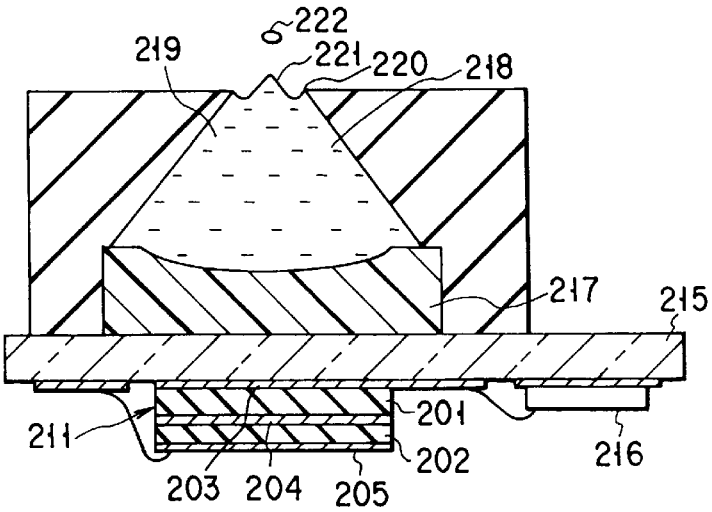
FIG. 11 is a sectional view showing a structure of the ink-eject head part of the second embodiment.

FIG. 11 is a sectional view showing a structure of the ink-eject head part in the ink-eject printer of the second embodiment. In this ink-eject head part, for a piezoelectric element 211 the piezoelectric element having the structure shown in FIG. 10A is used. This piezoelectric element 211 is formed on an acoustic matching layer 215 made of, for instance a glass plate. The electrode 203 is electrically connected to a drive IC 216 provided in the piezoelectric element 211 side on the acoustic matching layer 215 by means of wire bonding, etc., and an electrode 205 is electrically grounded.

On a surface in a side opposite to the piezoelectric element 211 on the acoustic matching layer 215 an acoustic lens 217 is fixed and a surface in a side opposite to the acoustic matching layer 215 of this acoustic lens 217 is in contact with a bottom surface of the ink 219 in the ink chamber 218. In this example, a buklens is used for the acoustic lens 217, but a fresnel acoustic lens may also be used.

The ink chamber 218 is formed gradually narrowing so as to envelope passages of acoustic waves focused by means of the acoustic lens 217 and becomes a slit formed orifice 220 having a width of about several tens μm to several hundreds μm in the vicinity of a focusing point of the acoustic waves. A surface of the ink 219 (ink liquid surface) is positioned on almost the same plane as the orifice 220.

The drive IC 216 supplies high frequency drive signals to the piezoelectric element 211 according to gray scale image data. In this way, acoustic waves are emitted from the piezoelectric element 211 to the acoustic matching layer 215 side. The emitted acoustic waves are focused by means of the acoustic lens 217 and then focused in a point form in the vicinity of the ink liquid surface. By means of pressure (discharging pressure) of the acoustic waves focused in the vicinity of the ink liquid surface, a conic ink liquid mound 221 is formed on the ink liquid surface and from a tip of this formed ink liquid mound 221 an ink droplet 222 is squirted. The squirted ink droplet 222 is ejected and stuck to an object to be printed, not shown, and the ink droplet 222 stuck to the printed object is dried and deposited. By performing a similar operation while performing main and subscanning by relatively moving the ink-eject head and the printed object, it is possible to print two-dimensional images thereon.

Next, explanation will be made of gray scale control processing for printing images on the object to be printed according to a plurality of gray scale levels.

Figure 12:
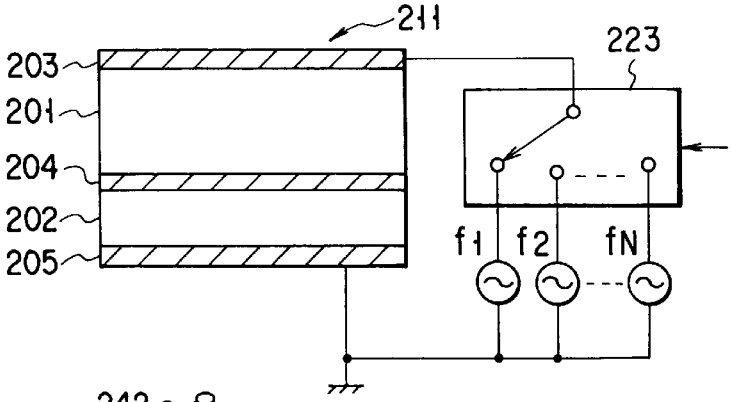
FIG. 12 is a model view illustrating an operation of a drive IC in the ink-eject printer of the second embodiment.

The drive IC 216 is provided with a function for switching frequencies of drive signals applied to the piezoelectric element 211 according to a gray scale level of an image (gray scale image) to be printed on the printed object, that is, according to a density value of gray scale image data. By means of this frequency switching function, it is possible to print the gray scale image on the printed object by controlling a size of an ink droplet from the ink liquid surface. FIG. 12 is a view showing an operation principle of the drive IC 216, and this is structured in such a manner that high frequency drive signal source of frequencies f1, f2, . . . , fN is provided and by switching of a switch 223 according to a density value of image data one of high frequency drive signals of f1, f2, . . . , fN is applied to the piezoelectric element 211. Here, f1 is a basic frequency of the piezoelectric element 211 and f2, . . . , fN are respectively secondary, third, fourth, . . . and Nth higher harmonic frequencies. As shown in FIG. 11, when the ink-eject head is structured in such a manner that one piezoelectric element is provided, one ink droplet is squirted and one pixel is printed, by switching the frequencies of the drive signals, N kinds of ink droplet sizes are realized and a gray scale image of N gray scale can be printed.

More specifically, an experiment was made by using a PZT type (zircon titanium acid chloride) ceramic having a dielectric constant of 2000 as a piezoelectric material, forming Ti/Au as an electrode by means of sputtering so as to have winding pressure of 0.05 μm/0.2 μm and using a piezoelectric element with a thickness 115 μm of the piezoelectric layer 201 and a thickness 55 μm of the piezoelectric layer 202 and it was found that the sizes of the ink droplet controlled in three stages almost in reverse proportion to the frequencies of the drive signals applied to the piezoelectric element, that is, when N=3, f1=10 MHz (f2=20 MHz, f3=30 MHz), the size of the ink droplet was 200 μm with f1, it was 100 μm with f2 and it was about 70 μm with f3.

In the conventional piezoelectric element of a single plate structure, since this can be driven only with a basic wave frequency or an odd-numbered frequency, if the size of the ink droplet is to be controlled in three stages and if f1=10 MHz, the frequencies of the drive signals applied to the piezoelectric element must be controlled in three stages of f1=10 MHz, f3=30 MHz and f5=50 MHz. However, since efficiency of the piezoelectric element steeply declines during high frequency resonance, a power of acoustic waves are reduced in, for instance f5=50 MHz and thus there is a possibility that forming of ink droplets will be difficult. On the other hand, according to the second embodiment, even when the size of the ink droplet is to be controlled similarly in three stages, only f3=30 MHz is needed as the highest frequency of the drive signal applied to the piezoelectric element, making it possible to secure a relatively large power of the acoustic waves even with this highest frequency.

Figure 13:
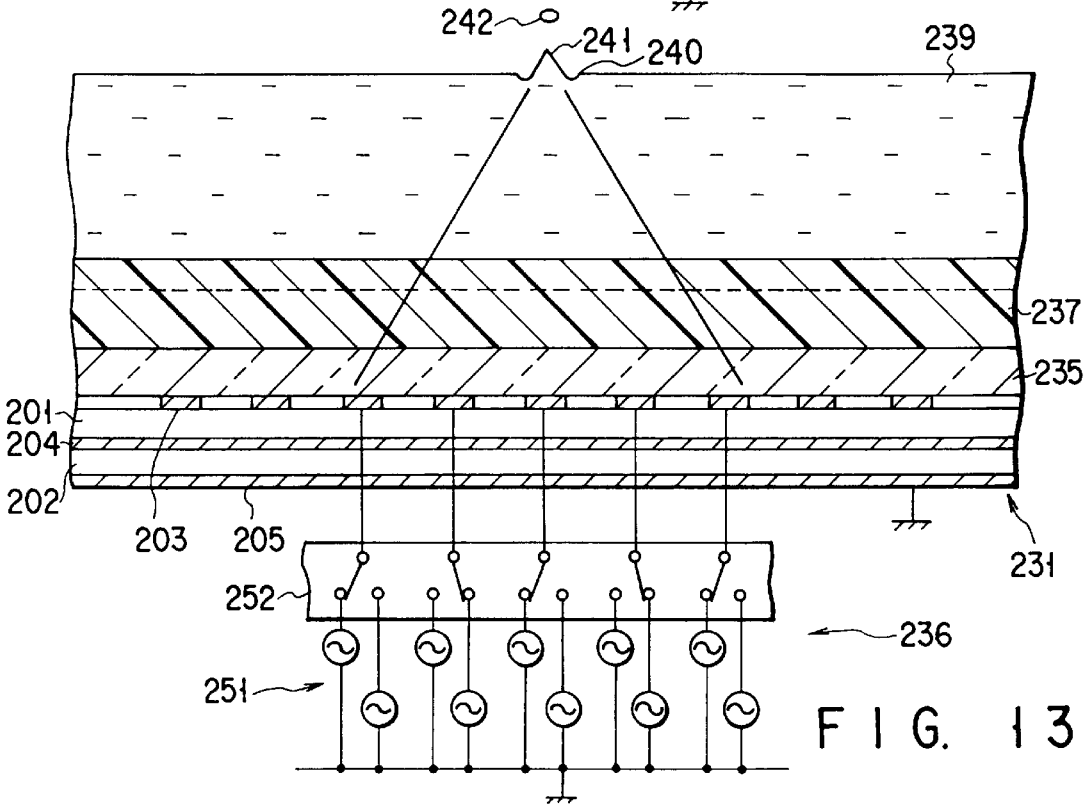
FIG. 13 is a view showing a modified example of the ink-eject head part in the ink-eject printer of the second embodiment.

FIG. 13 shows a modified example of the ink-eject head part in the ink-eject printer of the second embodiment and shows in section a phased array type ultrasonic ink-eject head along an main scanning direction using a piezoelectric element array in which a plurality of piezoelectric elements are one-dimensionally disposed in a scanning direction. A piezoelectric element array 231 is basically structured in such a manner that the piezoelectric elements shown in FIG. 10A are one-dimensionally arrayed and as in the case shown in FIG. 11 this is formed on an acoustic matching layer 235 made of a hear-resistance glass. In this case, the electrode 203 on the piezoelectric layer 201 is formed electrode in the main scanning direction as a whole, but this is separated so as to form a plurality of piezoelectric elements. The electrode 205 under the piezoelectric layer 202 is a beltlike electrode common to the respective piezoelectric elements. Each separated electrode 203 is electrically connected to a drive IC 236 (in FIG. 13 this is shown as a simple equalizer circuit) fixed to the piezoelectric element array 231 on the acoustic matching layer 235 by means of wire bonding, etc., and the electrode 205 as a common beltlike electrode is electrically grounded.

On a surface in a side opposite to the piezoelectric element array 231 on the acoustic matching layer 235 there is fixed a cylindrical planoconcave lens 237 for focusing acoustic waves in a direction orthogonal to the main scanning direction of the piezoelectric element array 231 and a direction for discharging the acoustic waves and a surface in a side opposite to the acoustic matching layer 235 of this acoustic lens 237 is in contact with a bottom surface of ink 239 in an ink chamber. In this example, a buklens is used for the cylindrical planoconcave lens 237, but a fresnel acoustic lens having a planar structure may also be used. The ink chamber is formed gradually narrowing so as to envelope passages of the acoustic waves focused by means of phased array scanning by the piezoelectric element array 231 and the cylindrical planoconcave lens 237 and in the vicinity of a focusing point of the acoustic waves a slit 240 having a width of several tens $\mu$m to several hundreds $\mu$m is formed. A surface of the ink 239 (ink liquid surface) is positioned almost on the same plane as the slit 240.

The drive IC 236 performs phased array scanning by driving the piezoelectric elements by block unit according to gray scale image data with a specified number of adjacent piezoelectric elements in the main scanning direction of the piezoelectric element array 231 as one block. More specifically, high frequency drive signals having specified phase differences are supplied from a drive signal source 251 to the respective piezoelectric elements of the selected blocks via a switch 252 and by simultaneously driving these piezoelectric elements acoustic waves emitted from the piezoelectric element array 231 are focused in the main scanning direction. This operation is repeated by shifting positions of the simultaneously driven piezoelectric elements by, for instance one element in sequence and thereby the direction for discharging the acoustic waves to be focused can be moved linearly in the main scanning direction.

The acoustic waves emitted from the piezoelectric element array 231 and focused in the main scanning direction are made incident to the cylindrical planoconcave lens 237 via the acoustic matching layer 235, further focused in a direction orthogonal to the main scanning direction and then focused in the vicinity of the ink liquid surface in a point form. Thereafter, as in the case of the previous embodiment, by means of pressure (discharging pressure) generated by the acoustic waves focused in the vicinity of the ink liquid surface, a conical ink liquid mound 241 is grown on the ink liquid surface and from a tip of this ink liquid mound 241 an ink droplet 242 is squirted. The squirted ink droplet 242 is ejected and stuck to an object to be printed, not shown, and this ink droplet 242 stuck thereto is dried and deposited. In this case, after main scanning is performed by means of a movement of the acoustic waves in the main scanning direction of the piezoelectric element array 231, subscanning is performed by relatively moving the ink-eject head part and the printed object in a direction orthogonal to the main scanning direction (main scanning direction), and by repeating a similar operation it is possible to a two-dimensional image on the printed object.

Here, a drive signal source of the drive IC 236 is structured so as to be provided with a plurality of frequencies (in FIG. 13 two kinds of frequencies) and capable of controlling phases and the drive IC 236 is provided with a function for controlling frequencies of drive signals applied to the piezoelectric element array 231 so as to control sizes of ink droplets from the ink liquid surface according to a gray scale level of an image (gray scale image) to be printed on the printed object, that is, according to a density value of image data. By controlling the sizes of the ink droplets from the ink-eject head, it is possible to print a gray scale image on the printed object. Also, by controlling the phases of the drive signals as in the case of the previous embodiment, it is possible to focus the acoustic waves in the main scanning direction of the piezoelectric element array.

As described above, according to the second embodiment, since by using the piezoelectric element having a laminated layer structure capable of exciting not only odd-numbered but also even-numbered ultrasonic waves and controlling frequencies of the acoustic waves emitted from the piezoelectric element in more multilevels the sizes of the ink droplets can be controlled in a wide range, it is possible to perform multi-level printing and also high speed printing because one pixel can be printed by one driving of the piezoelectric element. Furthermore, since by controlling the sizes of the ink droplets sizes of pixels and densities can be controlled, it is possible to perform a multivalue area gradation capable of obtaining the same gray scale within a smaller pixel compared with a binary are gradation in an area gradation method, which is also advantageous in terms of resolution.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An ink-jet printer for printing images on a printing medium, comprising:

an ink holding chamber for holding liquid ink;

an acoustic wave generator having a piezoelectric element acoustically connected to the liquid ink;

a signal source for applying a rf (radio frequency) tone burst to said piezoelectric element in order to emit multiple acoustic waves from said acoustic wave generator; and a first controller for changing a time to apply the rf tone burst in accordance with a desired gray-level of half tone so as to change a number of ejected ink droplets of an ink droplet group comprising a plurality of ink droplets, said ink droplet group being caused by the rf tone.

2. An ink-jet printer according to claim 1, further comprising:

a second controller for controlling said signal source so that after the ink droplet group caused by the rf tone burst is ejected, a following rf tone burst is applied so as to eject a following ink droplet group.

3. An ink-jet printer according to claim 1, further comprising:

focusing means for focusing the acoustic waves at a predetermined position in proximity to a surface of the liquid ink in order to generate acoustic pressure for ejecting a the ink droplet group.

4. An ink-jet printer according to claim 3, wherein said acoustic wave generator has a plurality of the piezoelectric elements arrayed in a scanning direction.

5. An ink-jet printer according to claim 4, wherein said signal source applies the rf tone burst having different phase, to the piezoelectric elements, respectively, thereby to cause the piezoelectric elements to emit acoustic waves which focus at the surface of the liquid ink.

6. An ink-jet printer according to claim 3, wherein said focusing means includes an acoustic lens.

7. An ink-jet printer according to claim 6, wherein said acoustic lens includes a Fresnel lens.

8. An ink-jet printer according to claim 1, wherein said first controller changes the time so that when the ink droplet group is ejected, the rf tone burst is continuous during the time being not less than $1.2 \times t \times n$, where t is a shortest time required to eject one ink droplet.

9. An ink-jet printer according to claim 1, wherein said acoustic wave generator has a plurality of the piezoelectric element arrayed in a scanning direction.

10. An ink-jet printer according to claim 9, wherein said signal source applies the rf tone bursts having different phase, to the piezoelectric elements, respectively, thereby to cause the piezoelectric elements to emit acoustic waves which focus at the surface of the liquid ink.

11. An ink-jet printer according to claim 9, wherein said focusing means includes an acoustic lens.

12. An ink-jet printer for printing images on a printing medium, comprising:

an ink holding chamber for holding liquid ink;

an acoustic wave generator having a piezoelectric element acoustically connected to the liquid ink;

a signal source for applying a rf (radio frequency) tone burst to said piezoelectric element in order to emit multiple acoustic waves from said acoustic wave generator and;

a first controller for changing a time in order to eject a plurality of ink droplets, wherein the time is less than $n \cdot (t+T)$, where $(t+T)$ is a shortest time required to eject one ink droplet from a prescribed position and n is a number of the plurality of ink droplets and is a positive integer which is greater than or equal to 2, thereby to print images according to desired gray-level of half-tone level on the printing medium.

13. An ink-eject printer comprising:

an ink holding chamber for holding liquid ink;

a piezoelectric element including, a first electrode, a first piezoelectric layer, a second electrode, and a second piezoelectric layer which are laminated in sequence; and driving means for applying a drive signal, other than a direct current pulse, between the first electrode and the second electrode of the piezoelectric element so as to emit ultrasonic waves excited by a secondary harmonic frequency in addition to a fundamental frequency to liquid ink from the piezoelectric: element, thereby ejecting at least one ink droplet from the ink.

14. An ink-eject printer according to claim 13, wherein the driving means is for changing a frequency of the drive signal according to a desired gray-level so as to change a size of the at least one ink droplet.

15. An ink-eject printer comprising:

an ink holding chamber for holding liquid ink;

a piezoelectric element including, a first electrode, a first piezoelectric layer, a second electrode, a second piezoelectric layer, and a third electrode which are laminated in sequence, said first and second piezoelectric layers being polarized in opposing directions to each other; and driving means for applying a drive signal, other than a direct current pulse, between the first electrode and the third electrode of the piezoelectric element so as to emit ultrasonic waves excited by a secondary harmonic frequency in addition to a fundamental frequency to liquid ink from the piezoelectric element, thereby ejecting at least one ink droplet from the ink.

16. An ink-eject printer according to claim 15, wherein the driving means is for changing a frequency of the drive signal according to a desired gray-level so as to change a size of the at least one ink droplet.

17. An ink-eject printer comprising:

an ink holding chamber for holding liquid ink;

a piezoelectric element including, a first electrode, a first piezoelectric layer, a second electrode, second piezoelectric layer, and third electrode which are laminated in sequence, said first and second piezoelectric layers being polarized in the same direction; and driving means for applying a drive signal, other than a direct current pulse, between the second electrode and the first and third electrodes of the piezoelectric element so as to emit ultrasonic waves excited by a secondary harmonic frequency in addition to a fundamental frequency to liquid ink from the piezoelectric element, thereby ejecting at least one ink droplet from the ink.

18. An ink-eject printer according to claim 17, wherein the driving means is for changing a frequency of the drive signal according to a desired gray-level so as to change a size of the at least one ink droplet.

* * * * *